US008253664B2

(12) United States Patent
Shih et al.

(10) Patent No.: US 8,253,664 B2
(45) Date of Patent: Aug. 28, 2012

(54) DISPLAY ARRAY WITH A PLURALITY OF DISPLAY UNITS CORRESPONDING TO ONE SET OF THE DATA AND SCAN LINES AND EACH COMPRISING A CONTROL UNIT

(75) Inventors: Li-Wei Shih, Minsyong Township, Chiayi County (TW); Chun-Huai Li, Wandan Township, Pingtung County (TW)

(73) Assignee: AU Optronics Corp., Hsinchu (TW)

( * ) Notice: Subject to any disclaimer, the term of this patent is extended or adjusted under 35 U.S.C. 154(b) by 1072 days.

(21) Appl. No.: 10/919,832

(22) Filed: Aug. 17, 2004

(65) Prior Publication Data

US 2005/0219172 A1 Oct. 6, 2005

(30) Foreign Application Priority Data

Mar. 30, 2004 (TW) ..... 93108640 A

(51) Int. Cl.
*G09G 3/32* (2006.01)

(52) U.S. Cl. ..... 345/82; 345/81

(58) Field of Classification Search ..... 345/76, 345/77, 78, 81, 82; 257/66, 72
See application file for complete search history.

(56) References Cited

U.S. PATENT DOCUMENTS 6,229,506 B1 * 5/2001 Dawson et al. ..... 345/82
6,229,508 B1 * 5/2001 Kane ..... 345/82
6,307,322 B1 * 10/2001 Dawson et al. ..... 315/169.1
6,348,906 B1 * 2/2002 Dawson et al. ..... 345/82
6,433,488 B1 * 8/2002 Bu ..... 315/169.3
6,580,657 B2 * 6/2003 Sanford et al. ..... 365/230.05
6,693,388 B2 * 2/2004 Oomura ..... 315/169.3
6,815,719 B2 * 11/2004 Akimoto ..... 257/72
6,847,171 B2 * 1/2005 Tam ..... 315/169.3
7,038,392 B2 * 5/2006 Libsch et al. ..... 315/169.3
2003/0062844 A1 4/2003 Miyazawa
2004/0196222 A1 * 10/2004 Shih et al. ..... 345/82
2004/0196224 A1 * 10/2004 Kwon ..... 345/82
2004/0196239 A1 * 10/2004 Kwon ..... 345/92
2004/0201557 A1 * 10/2004 Lo et al. ..... 345/82
2006/0038758 A1 * 2/2006 Routley et al. ..... 345/81

FOREIGN PATENT DOCUMENTS

GB PCT/GB03/02529 * 6/2003
TW 541510 3/1991
TW 558699 8/1991

OTHER PUBLICATIONS

China Office Action mailed Jan. 26, 2007.

* cited by examiner

*Primary Examiner* — Quan-Zhen Wang
*Assistant Examiner* — Calvin Ma
(74) *Attorney, Agent, or Firm* — Thomas|Kayden

(57) ABSTRACT

A display array. The display array applied in the panel of an organic light emitting display device comprises a plurality of data lines, a plurality of scan lines and a plurality of display units. Each display unit corresponds to one set of the data and scan lines and comprises a control unit, a driving transistor and a light emitting diode. In each display unit, the control unit adjusts light-emitting intensity of the light emitting diode in a frame cycle time according to the driving capability of the driving transistor.

22 Claims, 3 Drawing Sheets

DISPLAY ARRAY WITH A PLURALITY OF DISPLAY UNITS CORRESPONDING TO ONE SET OF THE DATA AND SCAN LINES AND EACH COMPRISING A CONTROL UNIT

BACKGROUND

The invention relates to a display panel, and in particular, a display panel employed in an organic light emitting display device.

FIG. 1 shows a schematic diagram of a conventional organic light emitting display panel. As shown in FIG. 1, a panel 1 comprises a data driver 10, a scan driver 11, and a display array 12. The data driver 10 controls a plurality of data lines $D_1$ to $D_n$ and the scan driver 11 controls a plurality of scan lines $S_1$ to $S_m$. The display array 12 is formed by interlaced data lines $D_1$ to $D_n$ and scan lines $S_1$ to $S_m$. The interlaced data line and scan line correspond to one display unit, for example, interlaced data line $D_1$ and scan line $S_1$ corresponding to display unit 100. As with any other display unit, the equivalent circuit of the display unit 100 comprises a switch transistor T10, a storage capacitor Cs1, a driving transistor T11, and an organic light-emitting diode (OLED) D1. The driving transistor T11 is a PMOS transistor.

The scan driver 11 sequentially outputs scan signals to scan lines $S_1$ to $S_m$ to turn on the switch transistors within all display units corresponding to one row and turn off the switch transistors within all display units corresponding to all other rows. The data driver 10 outputs video signals with gray scale values to the display units corresponding to one row through the data lines $D_1$ to $D_n$ according to prepared image data but not yet display. For example, when the scan driver 11 outputs a scan signal to the scan line $S_1$, the switch transistor T10 is turned on, the data driver 10 then outputs a corresponding video signal to the display unit 100 through the data line $D_1$, and the storage capacitor Cs1 stores the voltage of the video signal. According to the stored voltage in the storage capacitor Cs1, the driving transistor T11 provides a driving current Id1 to drive the OLED D1 to emit light.

Since the OLED D1 is a current-driving element, brightness of the OLED D1 is determined by the intensity of the driving current Id1. The total brightness of the OLED D1 in a frame cycle is the light-emitting intensity thereof. The driving current Id1 is a drain current of the driving transistor and refers to the driving capability thereof. The driving current Id1 is represented in the following equation:

$$id1=k(vsg1+vth1)^2$$

where id1, k, vsg1 and vth1 represent a value of the driving current Id1, a conduction parameter of the driving transistor T11, a value of the source-gate voltage Vsg of the driving transistor T11, and a threshold voltage of the driving transistor T11 respectively.

Since the driving transistors in different regions of the display array 12 are not identical electrically due to the fabrication process thereof, and the threshold voltages of the driving transistors are unequal. When the display units within different regions receive the same video signal, the driving current provided by the driving transistors of the display units respectively is not equal. Therefore, brightness of the OLEDs is not equal, resulting in unequal light-emitting intensity of the OLEDs in a frame cycle and uneven images displayed on the panel 1.

SUMMARY

According to the above issue, an embodiment of the invention provides a display array comprising a substrate, a plurality of data lines, a plurality of scan lines, and a plurality display units. The data lines and scan lines are disposed on the substrate. Each display unit corresponds to one set of data and scan lines and comprises a control unit, a driving transistor, and a light-emitting diode. In each display unit, the control unit controls light-emitting intensity of the light emitting diode.

A detailed description is given in the following embodiments with reference to the accompanying drawings.

BRIEF DESCRIPTION OF THE DRAWINGS

Various aspects of embodiments of the invention can be more fully understood by reading the subsequent detailed description and examples with references made to the accompanying drawings, wherein.

DETAILED DESCRIPTION

Figure 1:
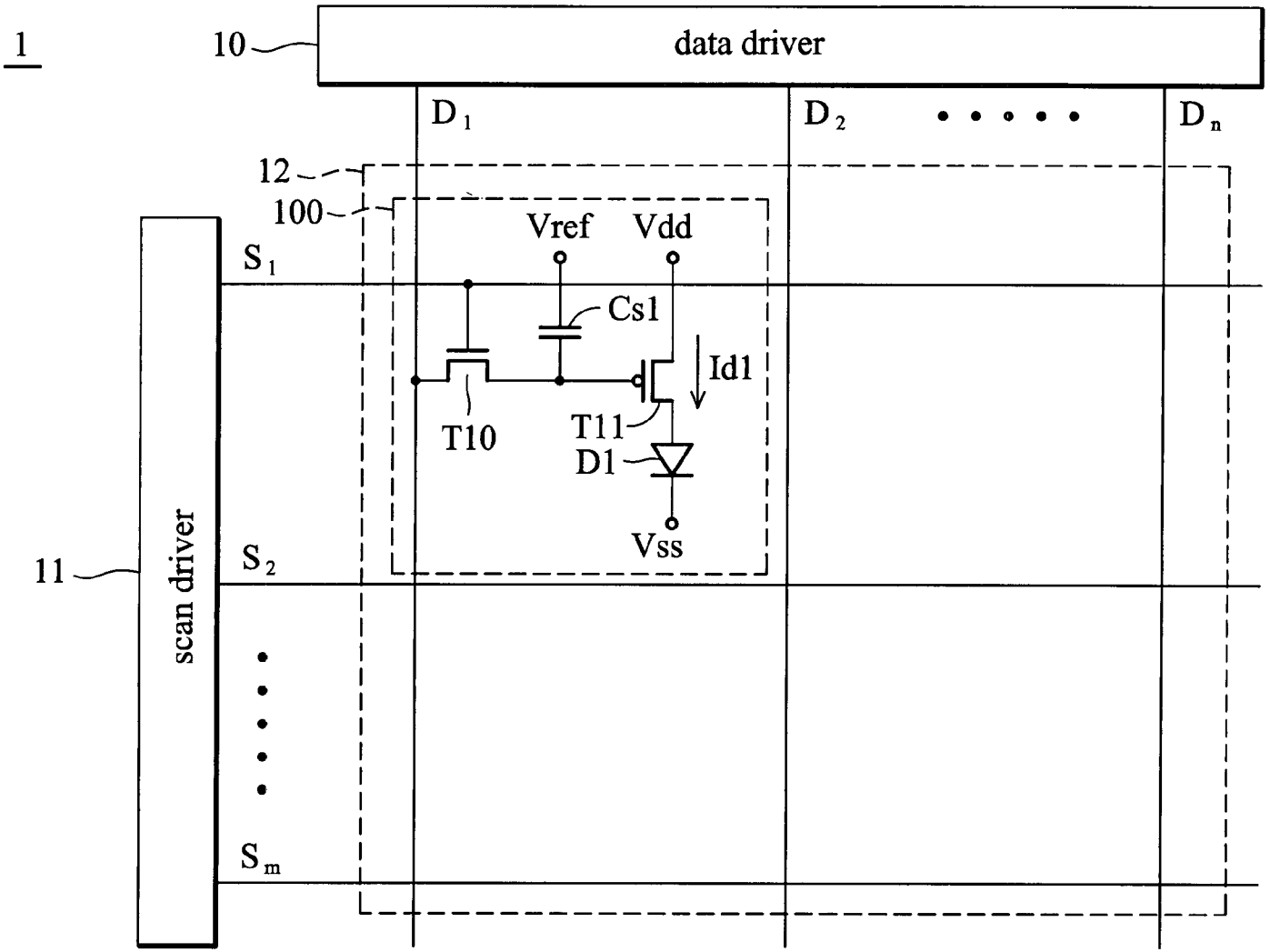
FIG. 1 ( RELATED ART )
FIG. 1 shows a schematic diagram of a conventional organic light emitting display panel.
Figure 2:
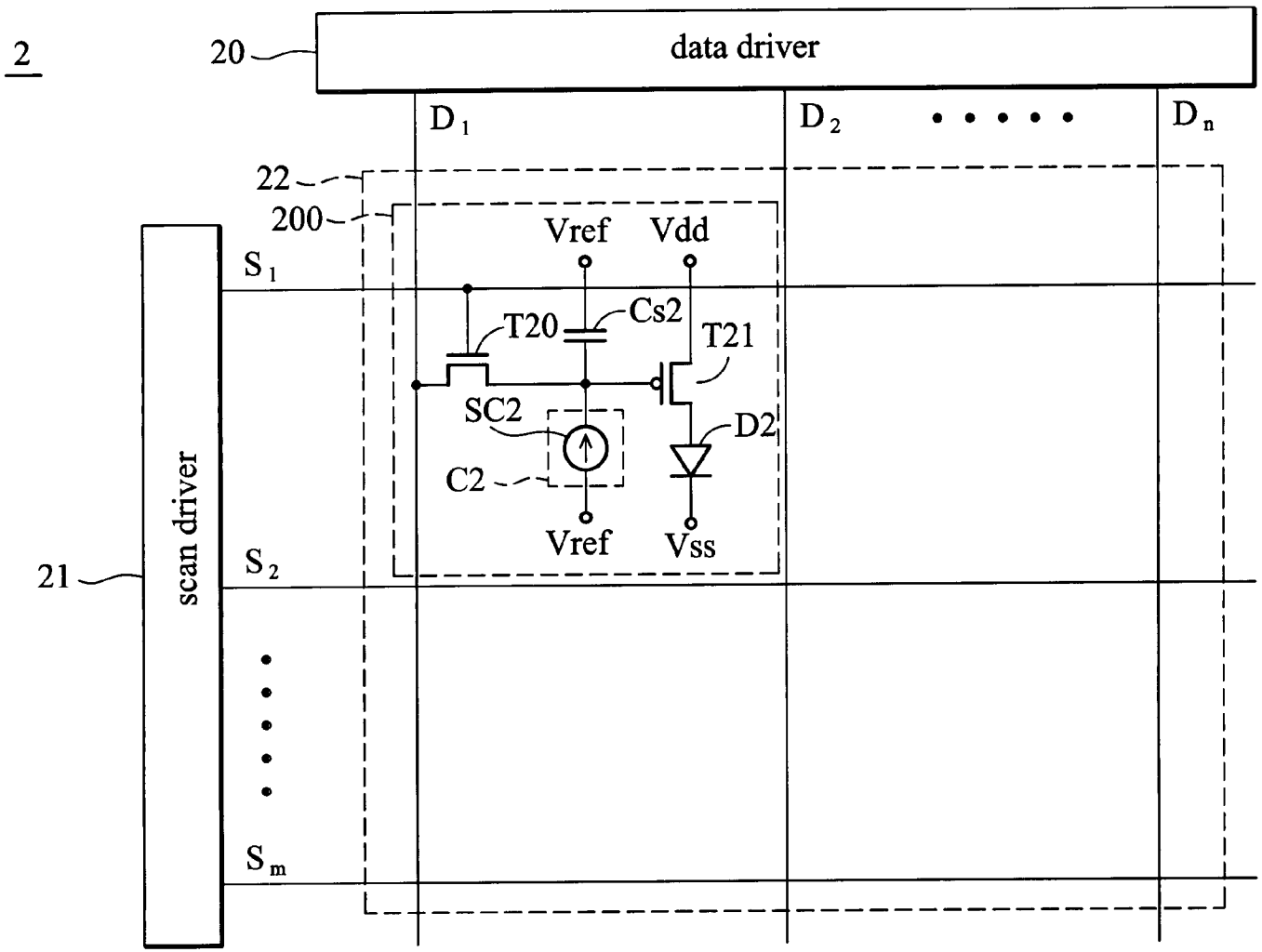
FIG. 2 shows a schematic diagram of an organic light emitting display panel of an embodiment of the invention.

FIG. 2 shows a schematic diagram of an organic light emitting display panel of an embodiment of the invention. The panel 2 comprises a data driver 20, a scan driver 21, and a display array 22. The data driver 20 controls a plurality of data lines $D_1$ to $D_n$ and the scan driver 21 controls a plurality of scan lines $S_1$ to $S_m$. The data lines $D_1$ to $D_n$ and the scan lines $S_1$ to $S_m$ are disposed on a substrate (not shown) of the panel 2. The display array 22 is formed by interlaced data lines $D_1$ to $D_n$ and scan lines $S_1$ to $S_m$. The interlaced data line and scan line correspond to one display unit, for example, interlaced data line $D_1$ and scan line $S_1$ corresponding to display unit 200. Like any other display unit, the equivalent circuit of the display unit 100 comprises a switch transistor T20, a storage capacitor Cs2, a driving transistor T21, an organic light-emitting diode (OLED) D2, and a control unit C2.

Figure 3:
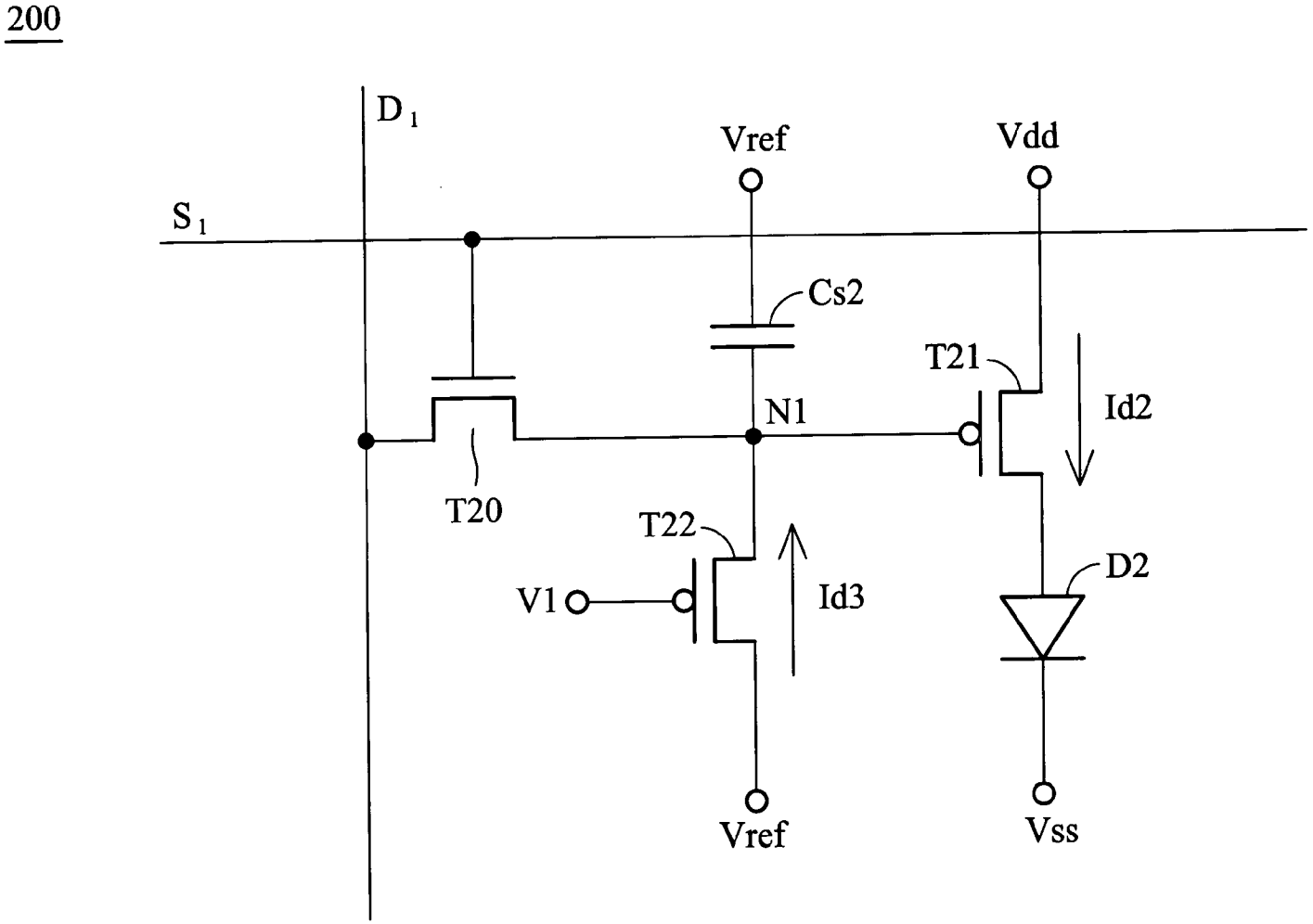
FIG. 3 shows a schematic diagram of one display unit of the display panel of FIG. 2.

As shown in FIG. 3, in the embodiment of the invention, the driving transistor T21 is a PMOS transistor, and the control unit is a current source SC2 realized by a PMOS transistor T22. In the display unit 200, a control terminal of the switch transistor T20 is coupled to the scan line $S_1$, an input terminal thereof is coupled to the data line $D_1$, and an output terminal thereof is coupled to a node N1. A drain of the transistor T22 is coupled to the node N1, a source thereof coupled to a reference voltage source Vref, and a gate thereof coupled to voltage source V1. One terminal of the storage capacitor Cs2 is coupled to the node N1, and the other terminal thereof is coupled to the reference voltage source Vref. A gate of the driving transistor T21 is coupled to the node N1, a source thereof is coupled to voltage source Vdd, and a drain thereof coupled the an anode of the OLED D2. A cathode of the OLED D2 is coupled to a voltage source Vss.

As described above, the driving transistors within different regions are not identical electrically, such that threshold voltages of these driving transistors are unequal. It is assumed that when the display unit 200 and other display units in different regions respectively receive video signals with the same voltage, the driving transistor T21 within the display unit 200 generates a larger driving current Id2 than other display units, that is, the driving transistor T21 has higher driving capability. In this embodiment of the invention, the current source SC2 is realized by a PMOS transistor T22 and the transistors T21 and T22 in the same region are substantially identical electrically.

When the scan driver 21 outputs a scan signal to the scan line $S_1$, the switch transistor T20 within the display unit 200 is turned on, the data driver 20 then outputs a corresponding video signal to the display unit 200 through the data line $D_1$, and the storage capacitor Cs2 stores a voltage Vdata of the video signal. At the same time, a voltage Vin of the node N1 is equal to the voltage Vdata. The transistor T22, however, charges the storage capacitor Cs2, such that the voltage Vin of the node N1 is changed. In other words, a source-gate voltage Vsg2 of the driving transistor T21 is charged and represented by the following equation:

$$vsg2=vdd-(vin+\Delta v) \quad \text{(Equation 1)}$$

where vsg2, vin, vdata and Δv represent the value of the voltage Vsg2, the voltage value of the voltage source Vdd, the value of the voltage Vin and variation of the voltage Vin respectively.

And then, $$\Delta v=id3\times t/cs2 \quad \text{(Equation 2)}$$

$$id3=k(v\text{ref}-v1+vth2)^2 \quad \text{(Equation 3)}$$

Therefore, $$\Delta v=[k(v\text{ref}-v1+vth2)^2]\times t/cs2 \quad \text{(Equation 4)}$$

where id3, vref, v1, vth2, cs2 and t represent the value of the current Id3, the voltage value of the voltage source Vref, the voltage value of the voltage source V1, a threshold voltage of the driving transistor T22, a value of the capacitor Cs2, and charge time for the transistor T22 charging the capacitor Cs2 respectively. The charge time is a constant and serves as a refresh time of a frame.

Combining Equations 1 and 4 produces $$vsg2=vdd-v\text{data}-[k(v\text{ref}-v1+vth2)^2]\times t/cs2 \quad \text{(Equation 5)}$$

Since the transistors T21 and T22 are in the same region, they are substantially identical electrically and have high driving capability. A large current Id3 is given in Equation 3. According to Equation 4, the variation Δv of the voltage Vin is enlarged due to the large current Id3. Then, according to Equation 5, the voltage Vsg2 is changed following the voltage Vin, such that the decrement of the current Id2 provided by the driving transistor T21 is large over a constant time. Therefore, brightness of the OLED D2 is lowered rapidly.

Conversely, when the threshold voltage of the driving transistors T21 and T22 is small, the currents Id2 and Id3 are small and brightness of the OLED D2 is rather small. According to Equations 1-5, however, since the variation of the voltage Vsg2 is decreased, the decrement of the driving current Id2 is small over a constant time, such that the brightness of the OLED D2 is lowered slowly.

According to this embodiment of the invention, brightness of an OLED driven by a driving transistor with high driving capability is lowered rapidly over a constant time, while brightness of an OLED driven by a driving transistor with low driving capability is lowered slowly over a constant time. In other words, the light-emitting intensity thereof is substantially the same. Thus, OLEDs in different regions can provide light with the similar light-emitting intensity in a frame cycle, and the panel displays images evenly.

In this embodiment of the invention, the transistors T21 and T22 can be NMOS transistors, thin film transistors, elements with the same fabrication process, or elements with equivalent circuitry. The panel 2 can be a liquid crystal display panel or low temperature poly silicon TFT liquid crystal display (LTPS-TFT LCD) panel.

While the invention has been described by way of example and in terms of the above, it is understood that the invention is not limited to the disclosed embodiment. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A display array, comprising:

a substrate;

a plurality of data lines disposed on the substrate;

a plurality of scan lines disposed on the substrate for receiving scan signals respectively; and a plurality of display units, each corresponding to one set of the data and scan lines and comprising a switch transistor, a control unit, a driving transistor, a storage capacitor, and a light-emitting diode, wherein each control unit comprises a first transistor having a gate coupled to a first voltage source for receiving a fixed voltage, a drain coupled to a gate of the driving transistor at a first node, and a source coupled to a reference voltage source;

wherein the storage capacitor has a first terminal coupled to the reference voltage source and a second terminal coupled to the gate of the driving transistor at the first node;

wherein in each of the display units, a control terminal of the switch transistor is coupled to the scan line for receiving the corresponding scan signal, an input terminal of the switch transistor is coupled to the data line, and an output terminal of the switch transistor is coupled to the first node;

wherein in each of the display units, the gate of the first transistor is physically separated from the control terminal of the switch transistor; and wherein, in each display unit, the control unit controls light-emitting intensity of the light emitting diode.

2. The display array as claimed in claim 1, wherein a source and a drain of the driving transistor respectively couple to a first voltage source and the light-emitting diode.

3. The display array as claimed in claim 1, wherein the light-emitting diode is an organic light-emitting diode.

4. The display array as claimed in claim 1, wherein the driving transistor is a thin film transistor.

5. A display panel, comprising:

a substrate;

a plurality of data lines disposed on the substrate;

a plurality of scan lines disposed on the substrate for receiving scan signals respectively;

a data driver coupled to the data lines;

a scan driver coupled to the scan lines; and a plurality of display units, each corresponding to one set of the data and scan lines and each comprising a switch transistor, a control unit, a driving transistor, a storage capacitor, and a light-emitting diode, wherein each control unit comprises a first transistor having a gate coupled to a first voltage source for receiving a fixed voltage, a drain coupled to a gate of the driving transistor at a first node, and a source coupled to a reference source;

wherein the storage capacitor has a first terminal coupled to the reference voltage source and a second terminal coupled to the gate of the driving transistor at the first node;

wherein in each of the display units, a control terminal of the switch transistor is coupled to the scan line for receiving the corresponding scan signal, an input terminal of the switch transistor is coupled to the data line, and an output terminal of the switch transistor is coupled to the first node;

wherein in each of the display units, the gate of the first transistor is physically separated from the control terminal of the switch transistor; and wherein, in each display unit, the control unit controls light-emitting intensity of the light emitting diode.

6. The display panel as claimed in claim 5, wherein a source and a drain of the driving transistor couple to a first voltage source and the light-emitting diode.

7. The display panel as claimed in claim 5, wherein the light-emitting diode is an organic light-emitting diode.

8. The display panel as claimed in claim 5, wherein the display panel is a liquid display panel.

9. The display panel as claimed in claim 5, wherein the display panel is a low temperature polysilicon TFT liquid crystal display panel.

10. The display panel as claimed in claim 5, wherein the driving transistor is a thin film transistor.

11. A display array, comprising:

a substrate;

a plurality of data lines disposed on the substrate;

a plurality of scan lines disposed on the substrate for receiving scan signals respectively; and a plurality of display units, each corresponding to one set of the data and scan lines and comprising a switch transistor, a control unit, a driving transistor, a storage capacitor, and a light-emitting diode, wherein each control unit comprises a first transistor having a gate coupled to a first voltage source for receiving a fixed voltage, a drain coupled to a gate of the driving transistor at a first node, and a source coupled to a reference voltage source;

wherein the storage capacitor has a first terminal coupled to the reference voltage source and a second terminal coupled to the gate of the driving transistor at the first node;

wherein in each of the display units, a control terminal of the switch transistor is coupled to the scan line for receiving the corresponding scan signal, an input terminal of the switch transistor is coupled to the data line, and an output terminal of the switch transistor is coupled to the first node; and wherein in each of the display units, the gate of the first transistor is physically separated from the control terminal of the switch transistor.

12. A display panel, comprising:

a substrate;

a plurality of data lines disposed on the substrate;

a plurality of scan lines disposed on the substrate;

a data driver coupled to the data lines;

a scan driver coupled to the scan lines for receiving scan signals respectively; and a plurality of display units, each corresponding to one set of the data and scan lines and each comprising a switch transistor, a control unit, a driving transistor, a storage capacitor, and a light-emitting diode, wherein each control unit comprises a first transistor having a gate coupled to a first voltage source for receiving a fixed voltage, a drain coupled to a gate of the driving transistor at a first node, and a source coupled to a reference source;

wherein the storage capacitor has a first terminal coupled to the reference voltage source and a second terminal coupled to the gate of the driving transistor at the first node;

wherein in each of the display units, a control terminal of the switch transistor is coupled to the scan line for receiving the corresponding scan signal, an input terminal of the switch transistor is coupled to the data line, and an output terminal of the switch transistor is coupled to the first node; and wherein in each of the display units, the gate of the first transistor is physically separated from the control terminal of the switch transistor.

13. A display array, comprising:

a substrate;

a plurality of data lines disposed on the substrate;

a plurality of scan lines disposed on the substrate for receiving scan signals respectively; and a plurality of display units, each corresponding to one set of the data and scan lines and comprising a switch transistor, a control unit, a driving transistor, a storage capacitor, and a light-emitting diode, wherein each control unit comprises a first transistor having a gate coupled to a first voltage source for receiving a fixed voltage, a drain coupled to a gate of the driving transistor at a first node, and a source coupled to a reference voltage source;

wherein the storage capacitor has a first terminal coupled to the reference voltage source and a second terminal coupled to the gate of the driving transistor at the first node;

wherein in each of the display units, a control terminal of the switch transistor is coupled to the scan line for receiving the corresponding scan signal, an input terminal of the switch transistor is coupled to the data line, and an output terminal of the switch transistor is coupled to the first node;

wherein in each of the display units, the first voltage and the corresponding scan signal are independent; and wherein, in each display unit, the control unit controls light-emitting intensity of the light emitting diode.

14. The display array as claimed in claim 13, wherein in each of the display units, the first voltage is provided from the first voltage source not from the scan line.

15. A display array, comprising:

a substrate;

a plurality of data lines disposed on the substrate;

a plurality of scan lines disposed on the substrate for receiving scan signals respectively; and a plurality of display units, each corresponding to one set of the data and scan lines and comprising a switch transistor, a control unit, a driving transistor, a storage capacitor, and a light-emitting diode, wherein each control unit comprises a first transistor having a gate coupled to a first voltage source for receiving a fixed voltage, a drain coupled to a gate of the driving transistor at a first node, and a source coupled to a reference voltage source;

wherein the storage capacitor has a first terminal coupled to the reference voltage source and a second terminal coupled to the gate of the driving transistor at the first node;

wherein in each of the display units, a control terminal of the switch transistor is coupled to the scan line for receiving the corresponding scan signal and an input terminal of the switch transistor is coupled to the data line;

wherein, in each display unit, the control unit controls light-emitting intensity of the light emitting diode;

wherein when the driving transistor has high driving capability and is used to drive the light-emitting diode, the light-emitting intensity of the light-emitting diode is lowered rapidly over a constant time; and wherein when the driving transistor has low driving capability and is used to drive the light-emitting diode, the light-emitting intensity of the light-emitting is lowered slowly over the constant time.

16. A display array, comprising:

a substrate;

a plurality of data lines disposed on the substrate;

a plurality of scan lines disposed on the substrate for receiving scan signals respectively; and a plurality of display units, each corresponding to one set of the data and scan lines and comprising a switch transistor, a control unit, a driving transistor, a storage capacitor, and a light-emitting diode, wherein each control unit is coupled to a gate of the driving transistor at a first node, and the driving transistor is used to drive the light-emitting diode according to a voltage of the first node;

wherein the plurality of display units are divided into a plurality of regions, a threshold voltage of each display unit in a first region among the plurality of regions is larger than a threshold of each display unit in a second region among the plurality of regions;

wherein when the display units in the first region and the second region among plurality of regions receive video signals with the same voltage, the control unit of each display unit in the first region controls variation of the voltage of the first node to be increased, and the control unit of each display unit in the second region controls the variation of the voltage of the first node to be decreased.

17. The display array as claimed in claim 16, wherein for each display unit, the control unit comprises a first transistor having a gate coupled to a first voltage source for receiving a fixed voltage, a drain coupled to a gate of the driving transistor at a first node, and a source coupled to a reference voltage source.

18. The display array as claimed in claim 16, wherein the storage capacitor has a first terminal coupled to the reference voltage source and a second terminal coupled to the gate of the driving transistor at the first node.

19. The display array as claimed in claim 16, wherein in each of the display units, the voltage source is physically separated from the control terminal of the switch transistor.

20. The display array as claimed in claim 16, wherein the variation of the voltage of the first node of each display unit in the first region is larger than the variation of the voltage of the first node of each display unit in the second region.

21. The display array as claimed in claim 16, wherein the driving transistor of each display unit generates a current to drive the light-emitting diode according to the voltage of the first node, and decrement of the current generated by the driving transistor of each display unit in the first region is larger than the decrement of the current generated by the driving transistor of each display unit in the second region.

22. The display array as claimed in claim 16, wherein reduction rate of brightness of the light-emitting diode of each display unit in the first region is larger than the reduction rate of the brightness of the light-emitting diode of each display unit in the second region.

* * * * *